US011585075B2

(12) United States Patent
Schurle et al.

(10) Patent No.: US 11,585,075 B2
(45) Date of Patent: Feb. 21, 2023

(54) SANITARY OUTLET UNIT

(71) Applicant: Neoperl GmbH, Mullheim (DE)

(72) Inventors: Holger Schurle, Mullheim (DE); Seoung-Eun Kim, Bad Krozingen (DE)

(73) Assignee: Neoperl GmbH, Müllheim (DE)

( * ) Notice: Subject to any disclaimer, the term of this patent is extended or adjusted under 35 U.S.C. 154(b) by 261 days.

(21) Appl. No.: 16/308,147

(22) PCT Filed: Sep. 15, 2017

(86) PCT No.: PCT/EP2017/001092

§ 371 (c)(1),
(2) Date: Dec. 7, 2018

(87) PCT Pub. No.: WO2018/050284

PCT Pub. Date: Mar. 22, 2018

(65) Prior Publication Data

US 2019/0194918 A1 Jun. 27, 2019

(30) Foreign Application Priority Data

Sep. 16, 2016 (DE) ..... 20 2016 005 687.6

(51) Int. Cl.
*B05B 1/30* (2006.01)
*E03C 1/084* (2006.01)

(52) U.S. Cl.
CPC ..... *E03C 1/084* (2013.01); *B05B 1/3006* (2013.01); *B05B 1/3033* (2013.01)

(58) Field of Classification Search
CPC . E03C 1/08; E03C 1/084; B05B 12/12; B05B 12/122; B05B 12/004; B05B 12/08; B05B 12/10; B05B 1/18; B05B 1/185; B05B 1/30; B05B 1/3006; B05B 1/3033; B05B 1/304; B05B 1/3066
See application file for complete search history.

(56) References Cited

U.S. PATENT DOCUMENTS

| | | | | |
|---|---|---|---|---|
| 2,954,936 A | | 10/1960 | Shames et al. | |
| 3,334,818 A | | 8/1967 | Moen | |
| 3,866,629 A | * | 2/1975 | Nicklas | E03C 1/0404 4/615 |
| 4,562,960 A | * | 1/1986 | Marty | E03C 1/084 239/106 |
| 8,151,826 B2 | * | 4/2012 | Dan | E03C 1/08 138/43 |

(Continued)

FOREIGN PATENT DOCUMENTS

| | | |
|---|---|---|
| CN | 104956007 | 9/2015 |
| CN | 105201049 | 12/2015 |

(Continued)

*Primary Examiner* — Christopher R Dandridge
(74) *Attorney, Agent, or Firm* — Volpe Koenig

(57) ABSTRACT

In a sanitary outlet unit (1), it is provided that a contact surface (6) is formed on a valve element (4) which is adjustable between an open position and a closed position in a flow path (2), which contact surface (6), in the open position, covers a corresponding, stationary counterpart surface (7) and, in the closed position, frees said counterpart surface (7), such that the valve element (4) is automatically held in the open position by the pressure in the flow path and returns to the closed position in the event of a pressure drop (cf. FIG. 1).

22 Claims, 7 Drawing Sheets

(56) References Cited

U.S. PATENT DOCUMENTS

| | | | | |
|---|---|---|---|---|
| 9,416,522 | B2 | 8/2016 | Tempel | |
| 9,639,095 | B2 | 5/2017 | Schurle et al. | |
| 2003/0141384 | A1* | 7/2003 | Grether | E03C 1/086 239/428.5 |
| 2006/0005311 | A1* | 1/2006 | Fentrouci | B05B 1/3026 4/615 |
| 2006/0145117 | A1* | 7/2006 | Kao | F16K 27/02 251/339 |
| 2011/0036930 | A1* | 2/2011 | Denzler | E03C 1/086 239/428.5 |
| 2016/0222637 | A1 | 8/2016 | Stein | |

FOREIGN PATENT DOCUMENTS

| | | |
|---|---|---|
| DE | 202015000855 | 6/2016 |
| EP | 1443151 | 8/2004 |
| WO | 2011147496 | 12/2011 |

* cited by examiner

SANITARY OUTLET UNIT

BACKGROUND

The invention relates to a sanitary outlet unit in which a valve element arranged in a flow path in a housing is switchable between an open position and a closed position, wherein the closed position is arranged below the open position in the use position.

The invention further relates to a method for actuating a valve, wherein a valve element arranged in a flow path in a housing is transferred from a closed position to an open position lying above the closed position.

In sanitary outlet units of this kind, which can basically have an outer contour permitting insertion into an outlet opening of a sanitary fitting, an aim is to provide different flow rates. In this connection, national legislation often stipulates that a flow rate for standard operation be limited to a prescribed level. However, there is a wish on the part of users to be able briefly to override such limitations on the flow rate.

WO 2011/147496 A1 discloses a sanitary outlet insert in which a flow cross section of a flow rate regulator or flow limiter can be preselected or varied by an axial change of a relative position of an adjusting element and of a counterpart element, wherein a handle is provided for this purpose at an outlet end of the outlet insert, said handle being configured as a pushbutton, and wherein an adjusting movement at the handle can be converted into an axial relative movement of adjusting element and counterpart element by a pushbutton mechanism. Such pushbutton mechanisms are generally bistable, such that there is generally no automatic return to a preferred starting position.

DE 20 12015 000 855 U1 discloses a sanitary insert unit which can be mounted on a water outlet of a sanitary outlet fitting and has a flow-restricting or control device with a flow-restricting or control element, wherein the flow-restricting or control device or at least the flow-restricting or control element thereof is guided displaceably under the pressure of the inflowing water from a starting position counter to a restoring force into a flow-restricting or control position.

U.S. Pat. No. 2,954,936 A discloses a jet aerator which can be secured to an outlet of a fitting by means of a connection element.

EP 1 443 151 A1 discloses a sanitary insert part with which it is possible to switch between an aerated jet and a shower jet.

U.S. Pat. No. 3,334,818 A discloses an outlet piece of a sanitary outlet fitting, having an adjustable element by means of which a cross section of a through-flow opening can be limited.

SUMMARY

The object addressed by the invention is that of improving the properties of use of a sanitary outlet unit while complying with legal provisions.

To meet this objective, one or more features of the invention are provided according to the invention in a sanitary outlet unit. In particular, in a sanitary outlet unit of the type described at the outset, the stated objective is thus met by the fact that the valve element has a contact surface which, in the open position, bears on the counterpart surface of the housing and, in the closed position, is spaced apart from the counterpart surface, such that the counterpart surface in the closed position is wettable by water in the flow path, and by the fact that an impingement surface is formed on the valve element and, in the open position, can be acted upon by a pressure prevailing in the flow path, such that the contact surface is pressed against the counterpart surface. The valve element can thus be held in the open position by the pressure that prevails in the flow path. As soon as this pressure drops, the valve element, for example by reason of its inherent weight, can fall to the closed position below the open position. This has the effect that, after a use, the sanitary outlet unit returns automatically to the limiting operation, in which the valve element in the closed position limits the flow path to a greater degree than in the open position. On the other hand, the invention has the effect that the valve element can be held automatically in the open position as long as there is sufficient water flowing in the flow path and therefore a sufficient pressure is built up. This facilitates use, since the user can transfer the valve element to the open position, for example manually, but does not need to hold the valve element in this open position. This improves the properties of use of the sanitary outlet unit, while at the same time complying with legal requirements according to which the standard setting in normal operation should be the flow-limited setting.

The impingement surface is preferably formed on a side of the valve element directed away from the contact surface. A contact pressure can thus be applied directly to the counterpart surface.

In one embodiment of the invention, provision can be made that a displacement body is formed on the valve element, which displacement body, in the open position, is arranged in a receiving space closeable by the contact surface and the counterpart surface and, in the closed position, is arranged at least partially outside the receiving space. In this way, pressure-controlled holding of the valve element in the open position can be improved. This is because the use of a receiving space, whose volume can for example be chosen to be only slightly greater than or equal to the volume of the displacement body, makes it possible to develop an additional resistance to an automatic return to the closed position. Here, the embodiment exploits the fact that water can flow less easily than air into a receiving space, such that removal of the displacement body from the receiving space is more difficult in a water environment than in an air environment. The air environment comes about, for example, when the stream of water is switched off.

In one embodiment of the invention, provision can be made that the displacement body is guided in the receiving space. This facilitates a defined transfer of the valve element between the closed position and the open position. It is particularly expedient if the displacement body is guided displaceably. This permits simple movement profiles and may be beneficial in assisting the return movement under the force of gravity.

In one embodiment of the invention, provision can be made that at least one relief channel is formed between the displacement body and an inner wall of the receiving space, and water displaced from the receiving space is removable via said relief channel. This facilitates a transfer of the valve element to the open position, in which transfer the displacement body has to displace water from the receiving space. During the return to the closed position, the at least one relief channel may be expedient for aerating the receiving space in order to free the displacement body. It is particularly expedient if the at least one relief channel opens into the flow path. This simplifies the structural design of the sanitary outlet unit and permits simple removal of the displaced water from the receiving space.

In one embodiment of the invention, provision can be made that an actuating element is formed which is accessible from outside the housing and with which the valve element is transferable from the closed position to the open position. It is of advantage here that manual actuation, i.e. switching from the closed position to the open position, can be easily performed from the outside. The actuating element is preferably rod-shaped in order to be as simple as possible in design terms and/or in order to take up the least possible amount of space in the sanitary outlet unit. The rod-shaped actuating element is preferably oriented along the flow path. This has the advantage that the valve element can be operated from underneath the sanitary outlet unit in the position of use. On the one hand, the operating element can thus be effectively integrated within the external design of the sanitary outlet unit and, on the other hand, this means that no additional changes are needed, for example to a faucet outlet into which the sanitary outlet unit is to be inserted. Moreover, the transfer movement from the closed position to the open position is immediately apparent to the user, since the actuating element moves in the same direction as the valve element.

In one embodiment of the invention, provision can be made that the actuating element is configured separately from the valve element. It is of advantage here that the actuating element can detach from the valve element after transferring the valve element to the open position. The inherent weight of the actuating element does not therefore have to be supported by the water pressure. Provision is preferably made here that a part of the impingement surface can be covered by the actuating element and can be freed with respect to the flow path. Thus, the holding force for the valve element can additionally increase as soon as the actuating element is released from the valve element. Here, the invention exploits the fact that the freed part of the impingement surface is subjected to pressure during operation and can thus contribute to the holding force of the valve element in the upper, open position. The actuating element is preferably arranged so as to be movable independently of the valve element. A return to a starting position can therefore be effected independently of the valve element.

In one embodiment of the invention, provision can be made that the actuating element is guided in the housing. It is of advantage here that the movement of the actuating element can be defined independently of the movement of the valve element. Decoupling of the two movements is thus permitted. This simplifies the demands as regards tolerances that have to be observed so that the actuating element and the valve element are adjustable in a smooth action. It is particularly expedient if the actuating element is likewise guided displaceably. A movement of the valve element can thus be achieved directly by the actuating element without mechanical conversion.

In one embodiment of the invention, provision can be made that, in the open position in the flow path, the impingement surface is arranged upstream from a flow obstacle. It is thus possible for a sufficient water pressure to develop that is able to hold the valve element in the open position. The flow obstacle is preferably formed by a valve seat of the valve element or at a valve seat, for example near the valve seat. Additional flow obstacles can thus be omitted, which simplifies the structural design.

In one embodiment of the invention, provision can be made that the contact surface is formed at an encircling rim which, in the closed position, interacts with a valve seat, for example the aforementioned valve seat, to provide an at least partial closure. A closed position is thus easily formed which can be configured in the manner of a throttle or with more complex regulating functions. The use of an encircling rim has the additional advantage that installation space is easily created for forming the aforementioned contact surface.

In one embodiment of the invention, provision can be made that a flow rate regulator or flow rate limiter is arranged upstream from the valve element in the flow path. It is of advantage here that legal requirements can be complied with even in operating states of short duration. It is also of advantage that defined flow and/or pressure conditions can be established after the flow rate regulator or flow rate limiter, which conditions permit particularly good functioning of the sanitary outlet unit according to the invention.

In one embodiment of the invention, provision can be made that the contact surface, in the closed position, is on the inflow side of the valve element. It is of advantage here that the valve element, after first being released from the open position, can be brought automatically to the closed position by the water pressure in the flow path. For this purpose, the water pressure acts on the contact surface as soon as the latter has detached from the counterpart surface. In this way, the restoring action can thus be strengthened by the inherent weight of the valve element.

In one embodiment of the invention, provision can be made that the displacement body is made of a metallic material. It is of advantage here that a greater inherent weight can be achieved. Preferably, the entire valve element is made of the metallic material. Multiple components are thus avoidable at this location. Brass, for example, has proven to be a suitable metallic material.

In one embodiment of the invention, provision can be made that the actuating element is made of plastic. This permits particularly simple manufacture of the actuating element. Making the actuating element from plastic is particularly expedient if the actuating element is configured separately from the valve element and is arranged to be releasable from the latter. In this case, it is necessary that the actuating element is provided with a sufficient inherent weight, since it is not held back by the valve element.

In one embodiment of the invention, provision can be made that a flow baffle is arranged in such a way that, in the open position, the valve element is screened off in the circumferential direction at least in part. It is thus possible to reduce or even completely avoid a swirling flow of water impacting the valve element. It is thus possible to avoid unwanted detachment of the valve body from the counterpart surface, which could be caused by eddies and/or reflected flows pushing in between the contact surface and the counterpart surface. Provision is preferably made that the flow baffle screens off the valve body, in particular the rim thereof, along an entire circumferential length of the valve element, that is to say, for example, over an angle of 360°. Protection against undesired falling of the valve body to the closed position can thus be achieved all the way round. The flow baffle can enclose the valve body in a ring shape. It is expedient if the flow baffle describes a circular ring. The possibly non-round valve body thus fits into the ring of the flow baffle without the need for the valve body to be guided in a rotationally fixed manner.

The flow baffle can be arranged in a stationary position here, for example on the housing or on a support part or frame part. It is of advantage here that energy and/or impulses from swirling flow components can be easily taken up and/or routed around the valve element. It is particularly expedient if the flow baffle is arranged adjacent to the counterpart surface. A joining surface or a gap between the contact surface and the counterpart surface can thus be effectively screened off.

It is expedient if the flow baffle screens off the valve element at the rim thereof in order to particularly effectively avoid detachment. A height of the flow baffle is preferably matched to a height of the rim. In this way, the rim can be completely covered.

In this embodiment, provision can be made that the flow baffle is arranged along the flow path behind an impact surface. In this way, eddies or flows that are reflected from the impact surface and flow in the direction of the valve element are easy to control. Alternatively or in addition, provision can be made that the flow baffle protrudes into a valve chamber that receives the valve element.

In one embodiment of the invention, provision can be made that a flow straightener is arranged in the flow path before the valve element. A flow can thus be uniformly oriented. The development of eddies, which can in particular cause the valve element to detach from the counterpart surface and thus cause the valve element to fall to its closed position, can thus be reduced or can even be completely suppressed.

In one embodiment of the invention, provision can be made that the flow straightener has a multi-stage configuration. This can be more efficiently produced by injection molding compared to a one-piece design of a single and accordingly longer flow straightener. In principle, it appears conceivable also to take a thick straightener which simply has a plate or stage with bores. Here, however, account must be taken of boundary conditions of injection molding technology which, with the small bores here having a diameter of 0.25 mm for example, pose the danger of the bore holes being closed again by shrinkage during cooling. A multi-stage configuration can help avoid this effect.

By the multi-stage configuration, the so-called aspect ratio, i.e. the ratio of the diameter of the bores to the length of the bores, can be improved, such that the described closure of bores on account of shrinkage can be avoided.

The flow straightener can thus have one stage, two stages, or more than two stages, for example three, four or five stages or more than five stages.

In one embodiment of the invention, provision can be made that the flow straightener has at least one insert. A flow straightener can thus be retrofitted in an existing outlet unit and/or the flow straightener can be easily removed and/or exchanged subsequently. The insert preferably forms a stage of the flow straightener, in particular one of the stages already mentioned.

The or each insert can be configured here as a plate with bores, wherein the bores can provide a straightening effect as a result of the aforementioned aspect ratio.

If each stage is configured as an insert, a straightening behavior of the flow straightener can be easily modified by altering the number of inserts and/or by modifying the configuration of the inserts through replacement.

In one embodiment of the invention, provision can be made that at least one through-flow nozzle is arranged in the flow path between the flow straightener and the valve element. An edge of the through-flow nozzle can also form a support for the aforementioned inserts. It is particularly expedient if the flow baffle is attached steplessly to the through-nozzle. An undesired eddy formation can thus be reduced or even avoided.

It is particularly expedient here if a flow straightener, for example the flow straightener already described, is arranged before the through-nozzle. Eddies in the downstream valve chamber are thus largely avoidable.

In one embodiment of the invention, provision can be made that contact surface bears on the counterpart surface in a contact region, and a distance is formed outside of the contact region. It is thus possible for the contact surface to bear flat on the counterpart surface with minimal gaps or even with no gaps, without which technically unavoidable surface irregularities in the vicinity of the contact region would adversely affect the function of the latter and in particular its ability to remain in the open position. It is expedient here if a surface area of the contact region is smaller than a surface area of a surface covered by the contact surface. Thus, an exact fit of the contact surface at the counterpart surface can be achieved since the contact region is chosen as small as possible. In order to achieve a good hold of the valve element in the open position by the internal pressure of the flowing water, the region in which a distance or gap is formed should extend along the contact surface as far as possible compared to the contact region.

Provision can be made that the contact region is delimited by a step. This represents a particularly simple means of observing the desired distance on the other side of the contact region and also of creating a good transition to the contact region. The step can in this case be formed in the contact surface and/or in the counterpart surface.

To achieve the stated objective, one or more features of the invention are provided in a method for actuating a valve. In particular, in a method of the type described at the outset, the stated problem is thus solved according to the invention by the fact that the valve element, in the open position, is acted upon by a pressure prevailing in the flow path, such that a contact surface of the valve is pressed and held against a counterpart surface on the housing. It is thus possible to ensure that the valve element remains automatically in the open position as long as a pressure is present in the flow path. This makes operation easier, since a user is not forced to hold the valve element in the open position.

In one embodiment of the invention, provision can be made that, after a pressure drop in the flow path, the valve element falls automatically to the closed position. It is thus possible to ensure that, in normal operation, the valve assumes a state in which the valve element is arranged in the closed position. It is particularly expedient if the valve element falls to the closed position by reason of its inherent weight. Additional restoring springs and the like can thus be omitted.

In one embodiment of the invention, provision can be made that the pressure is generated by a flow obstacle arranged downstream from the valve element in the open position. It is of advantage here that no additional pressure-generating means are necessary. It is particularly expedient if the flow obstacle is generated by a valve seat of the valve element and/or if the flow obstacle in the closed position defines a limitation or regulation of the flow of water in the flow path.

In one embodiment of the invention, provision can be made that, when the valve element is transferred to the open position, water is displaced from a receiving space for a displacement body of the valve element. It is of advantage here that an additional resistance can be built up against an automatic return of the valve element to the closed position as long as water is present. In particular, the displacement can take place via at least one relief channel, for example the relief channel already mentioned.

In one embodiment of the invention, provision can be made that the valve element, in the closed position, is held in a valve seat, for example the valve seat already mentioned, by a pressure developing at the contact surface in the flow path. It is of advantage here that a return movement of the valve element to the closed position can be strengthened or supported by a pressure in the flow path.

In one embodiment of the invention, provision can be made that a sanitary outlet unit according to the invention, in particular as described above and/or according to one of the claims directed to a sanitary outlet unit, is used. Thus, the described advantages of the sanitary outlet unit according to the invention can be utilized in the method according to the invention.

BRIEF DESCRIPTION OF THE DRAWINGS

The invention is now described in more detail on the basis of an illustrative embodiment, but it is not restricted to this illustrative embodiment. Further illustrative embodiments will emerge from the combination of individual or multiple features of the patent claims with one another and/or with individual or multiple features of the illustrative embodiment.

DETAILED DESCRIPTION

FIGS. 1 to 5 are first of all described jointly below, after which the different switching states are discussed in detail.

An outlet unit designated overall by reference sign 1 forms, within its interior, a flow path 2 for water to flow through. The flow path 2 is formed in a manner known per se in a multi-part housing 3.

Figure 1:
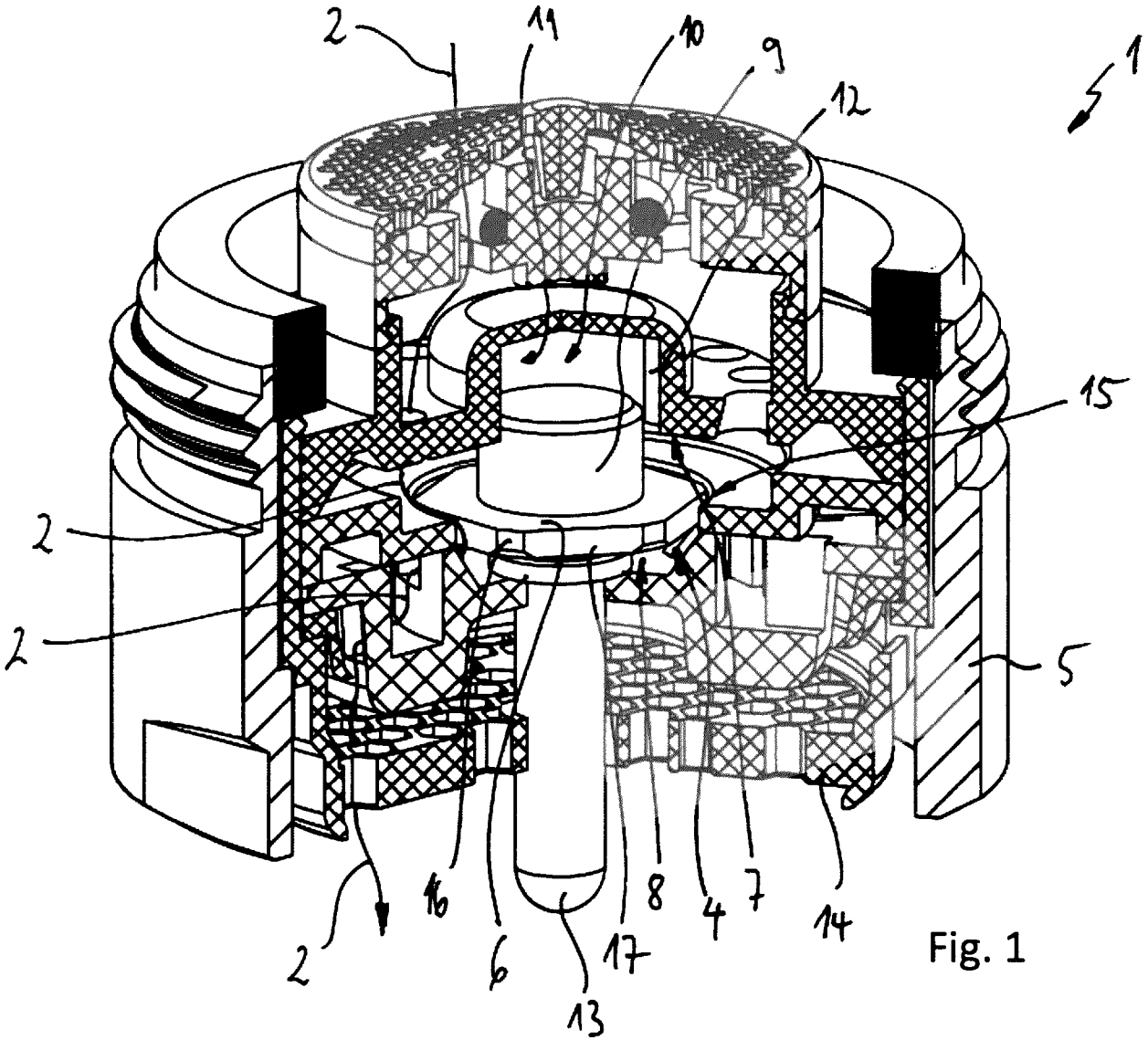
FIG. 1 shows a sanitary outlet unit according to the invention in a sectional view, wherein the valve element is located in the closed position.
Figure 3:
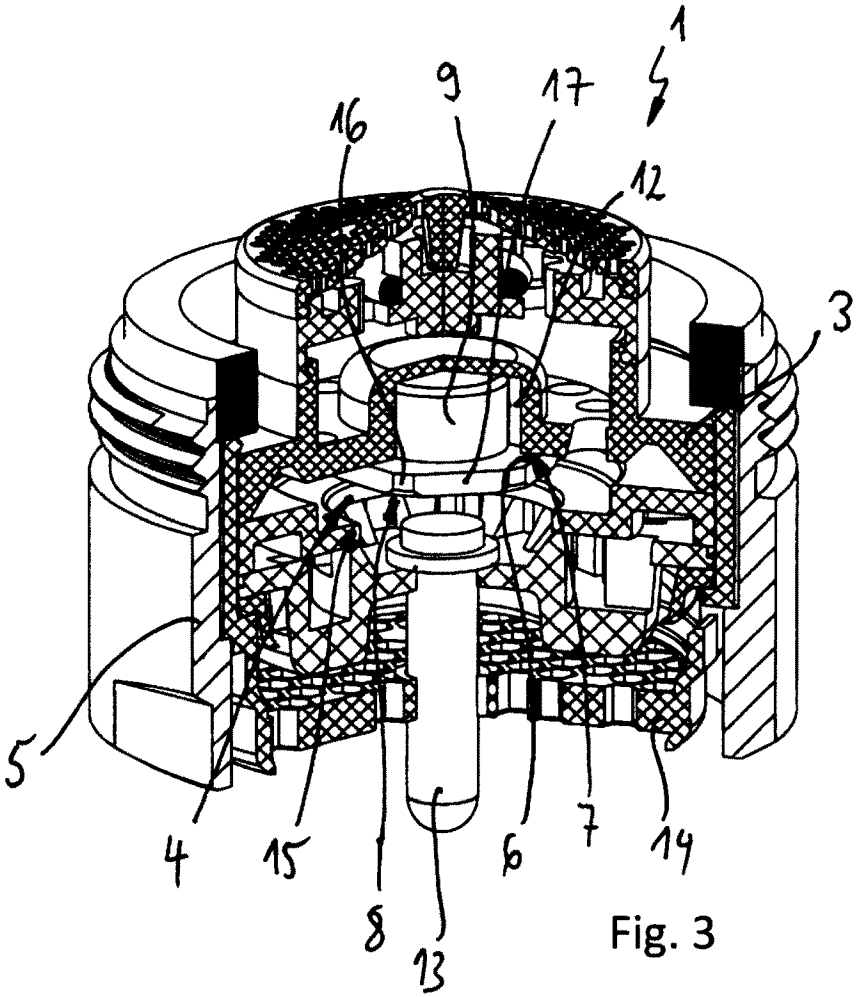
Figure 5:
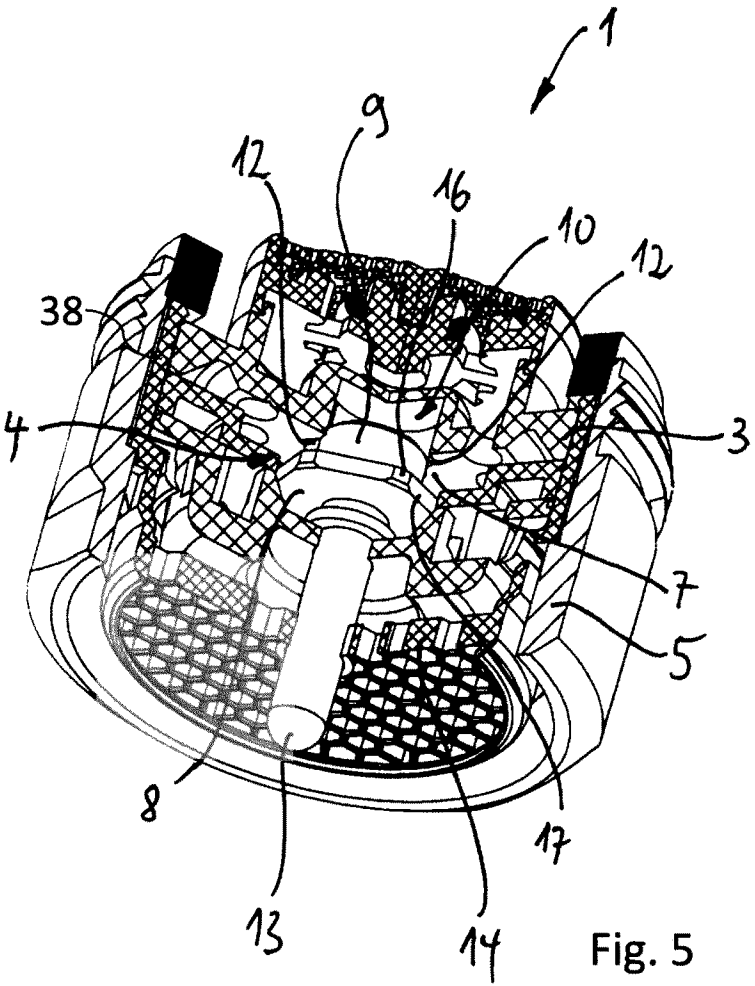
FIG. 5 shows the situation according to FIG. 1 in a view looking obliquely from below at the outlet structure.
Figure 4:
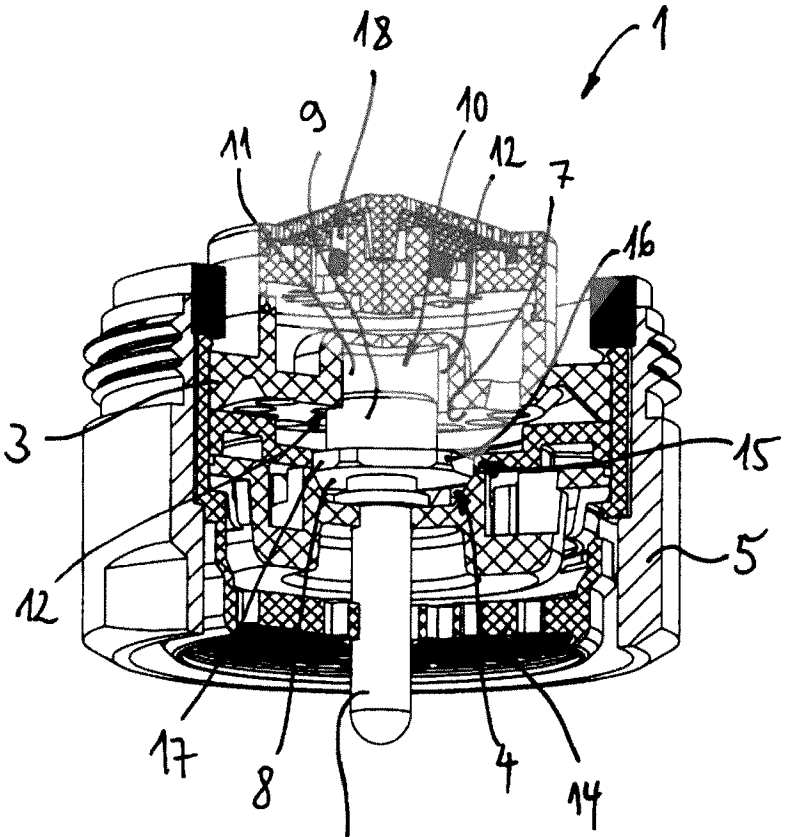
FIG. 4 shows the situation according to FIG. 1 in a side view.
Figure 8:
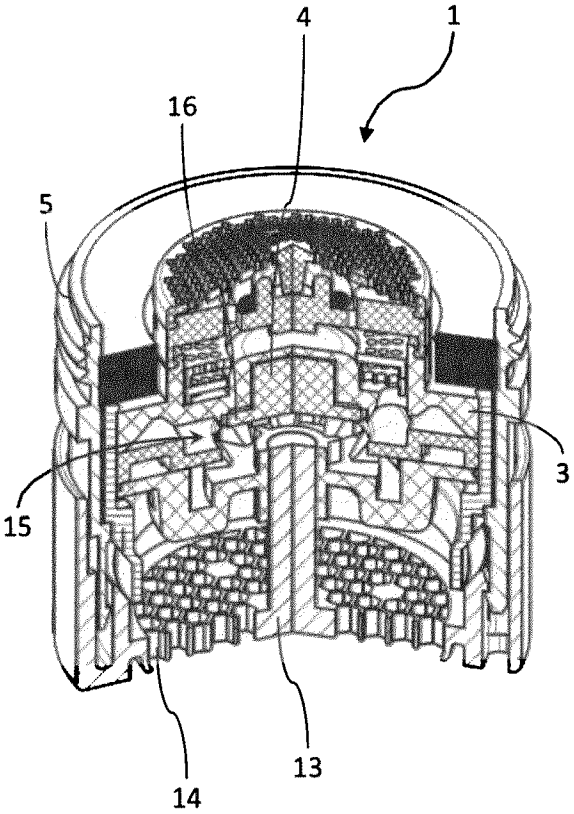
FIG. 8 shows the sanitary outlet unit according to FIG. 6, wherein the valve element is arranged in the open position and the actuating element is released from the valve element.
Figure 7:
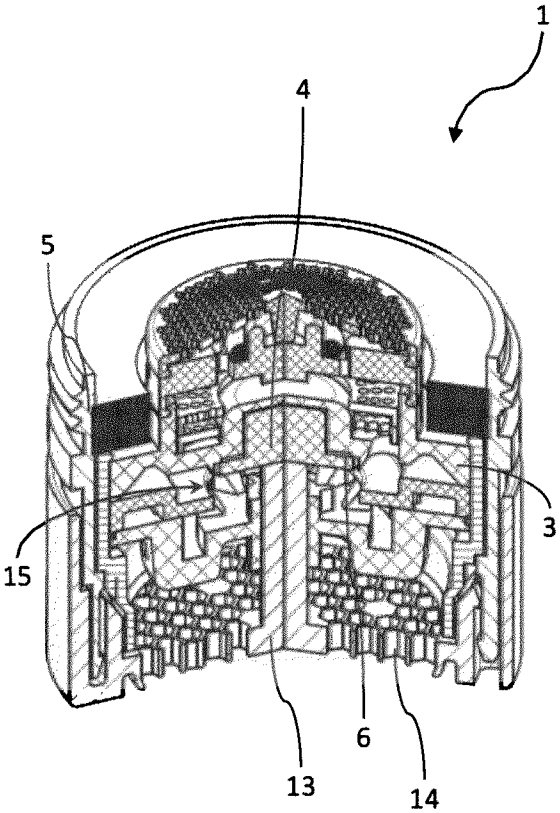
FIG. 7 shows the sanitary outlet unit according to FIG. 6, wherein the valve element is transferred with the actuating element to the open position.
Figure 6:
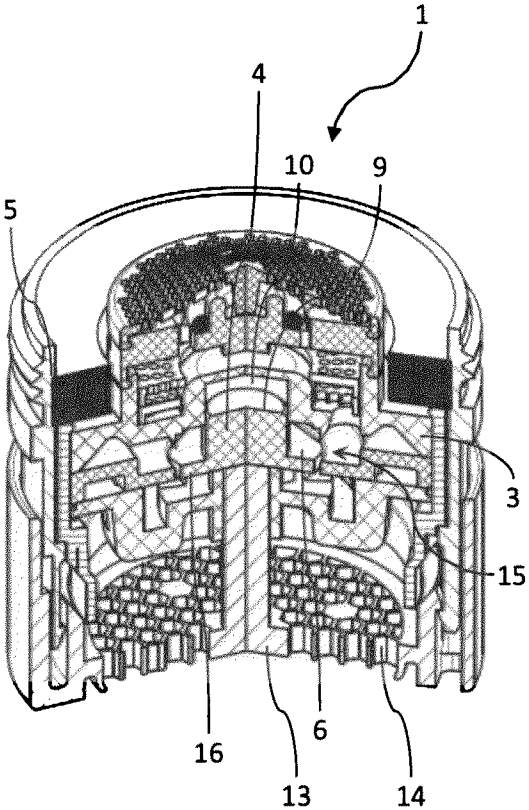
FIG. 6 shows a further outlet unit according to the invention in a sectional view, wherein the valve element is located in the closed position.

A valve element 4 is arranged in the flow path 2, which valve element 4 is switchable between an open position (FIGS. 2 and 3) and a closed position (FIGS. 1, 4 and 5).

The closed position is in this case arranged below the open position when the sanitary outlet unit 1 is used in the orientation according to FIG. 1. For this purpose, as has been stated, the closed position can be arranged exactly below the open position, or it can be arranged below the open position but laterally offset in relation to a position exactly below.

During use, the sanitary outlet unit 1 is held on a fitting (not shown in detail) by a mouthpiece 5 in a manner known per se.

A contact surface 6 is formed on the valve element 4. A corresponding counterpart surface 7 is formed on the housing 3 and interacts with the contact surface 6 in such a way that the counterpart surface 7 bears flat on the contact surface 6 in the open position of the valve element 4.

In the closed position, by contrast, the contact surface 6 is arranged at a distance from the counterpart surface 7.

In the closed position, the counterpart surface 7 is accessible from the direction of the flow path 2 and is therefore wetted if water is present in the flow path 2.

An impingement surface 8 is moreover formed on the valve element 4. The impingement surface 8 is oriented downward, whereas the contact surface 6 is oriented upward. In other words, the impingement surface 8 is in an orientation directed away from the contact surface 6.

In the open position of the valve element 4, the impingement surface 8 is thus acted upon by pressure and presses the valve element 4 against the counterpart surface 7.

A displacement body 9 is formed on the valve element 4 and fits into a receiving space 10.

Here, the displacement body 9 is shown by way of example with a cylindrical shape.

The displacement body 9 is guided displaceably in the receiving space 10 by the inner contour of the latter. In the open position, the displacement body 9 completely fills the receiving space 10. In the closed position, by contrast, the displacement body 9 is arranged partially outside the receiving space 10 and protrudes into the latter only as far as is necessary for said displaceable guiding.

A plurality of relief channels 12, through which water displaced from the receiving space 10 can flow back into the flow path 2, are formed between the displacement body 9 and an inner wall 11 of the receiving space 10.

A rod-shaped actuating element 13, which is accessible from the outside, is formed below the valve element 4.

The actuating element 13 is guided displaceably in an outlet structure 14 and acts on the valve element 4 from below, at the impingement surface 8.

The actuating element 13 is formed separately from the valve element 4, such that a part of the impingement surface 8 can be covered by and freed by the actuating element 13.

Figure 2:
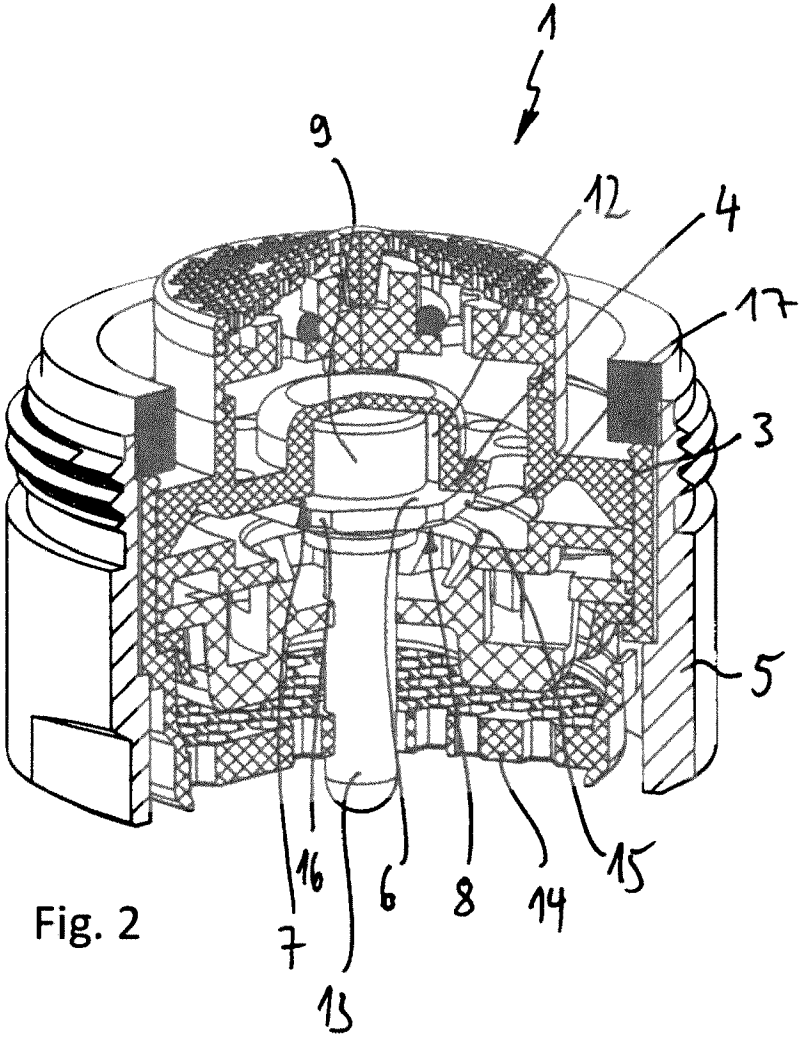
FIG. 2 shows the sanitary outlet unit according to FIG. 1, wherein the valve element is transferred with the actuating element to the open position, FIG. 3 Shows the sanitary outlet unit according to FIG. 1, wherein the valve element is arranged in the open position and the actuating element is released from the valve element.

This part of the impingement surface is covered in FIG. 2 and freed in FIG. 3.

The impingement surface 8 is arranged in the flow path 2 upstream from the valve seat 15. The valve seat 15 thus forms a flow obstacle in the flow path 2, such that a pressure builds up before the valve seat 15 and holds the valve element 4 in the open position.

The contact surface 6 and the impingement surface 8 are formed on an encircling rim 16 of the valve element 4. In the closed position, the rim 16 partially closes the valve seat 15 in order to achieve an additional narrowing. For this purpose, flattened regions 17, which each form gaps at the valve seat 15, are formed on the rim 16, which itself describes a round basic shape.

A flow rate regulator or flow rate limiter 18 is arranged upstream from the valve element 4 in the flow path 2, by which defined conditions can be set in the environment of the valve element 4.

In the closed position, the contact surface 6 is formed on the inflow side of the valve element 4, such that the valve element 4 is guided to the closed position by the flow pressure and is held in the closed position as soon as the contact surface 6 is released from the counterpart surface 7.

The displacement body 9 and the entire valve element 4 as a whole are made of brass. The actuating element 13, by contrast, is made of plastic, as also is the housing 3 with the outlet structure 14.

FIG. 1 shows the rest state of the sanitary outlet unit 1. The valve element 4 is arranged in the closed position.

During operation, the through-flow along the flow path 2 is thus defined by the valve element 4 and in particular by the flattened regions 17 in the valve seat 15.

When upward manual pressure is applied to the actuating element 13 from below, the valve element 4 is transferred to the open position according to FIG. 2. Here, water is displaced from the receiving space 10 through the relief channels 12 by the displacement body 9.

The valve element 4 is pressed with its contact surface 6 against the counterpart surface 7 on the housing 3.

In this open position, the impingement surface 8 is acted upon by the pressure built up or prevailing in the flow path 2, such that the valve element 4 is held in the open position.

Therefore, the valve element 4 remains in the open position even when the actuating element 13, left to itself, detaches from the valve element 4 and falls down. This holding in the open position continues as long as water flows in the flow path 2 and the necessary pressure is built up.

When the pressure drops in the flow path 2, the valve element 4 with the displacement body 9 falls back, by reason of its inherent weight, to the closed position according to FIG. 1.

In the open position, the valve seat 15 has a maximum free inner cross section, such that the through-flow rate is increased in relation to the closed position.

It is also evident from the figures that the pressure holding the valve element 4 in the open position is generated by the valve seat 15 and downstream flow obstacles.

FIGS. 6 to 13 are described jointly below, wherein components and functional units that are similar or identical in terms of function and/or design to components and functional units of the preceding illustrative embodiment are designated by the same reference signs and are not described separately again. The statements concerning FIGS. 1 to 5 therefore apply correspondingly to FIGS. 6 to 13.

The illustrative embodiment according to FIGS. 6 to 13 differs from the preceding illustrative embodiment at least in that a flow straightener 20 is formed upstream from a through-flow nozzle 23. This flow straightener 20 is in two layers, being composed of two stages, namely the first stage 21 and the second stage 22. Each stage 21, 22 is configured here as an annular insert 34.

In further illustrative embodiments, there are other numbers or shapes of stages 21, 22, for example three or more than three stages and/or circular disk-shaped inserts 34.

In FIGS. 6 to 13, a flow baffle 19 is formed in the valve chamber 28, which is formed along the flow path 2 behind the through-flow nozzle 23. The flow baffle 19 protrudes into the valve chamber 28 and encloses the valve element 4 along the full circumference of the rim 16. Here, the flow baffle 19 is pressed tightly onto the counterpart surface 7.

The flow baffle 19 has a height which is adapted to a thickness of the rim 16. Thus, the rim 16 is completely concealed behind the flow baffle 19.

Figure 11:
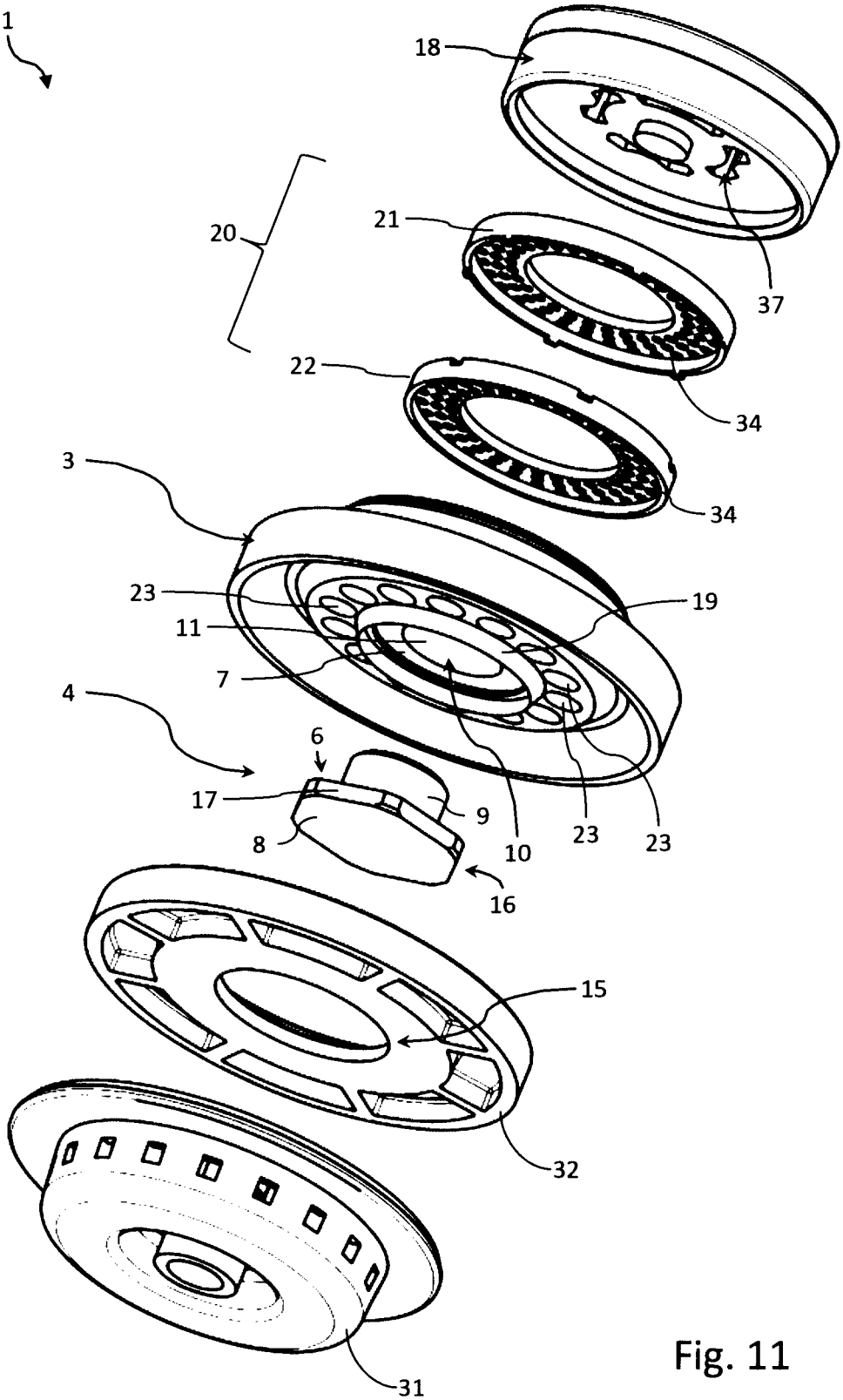
FIG. 11 shows the sanitary outlet unit according to FIG. 6 in an exploded view.

As will be seen from FIG. 11, the rim 16 has a non-round configuration, with the above-described flattened regions 17.

By contrast, the flow baffle 19 has a shape of a circular ring which encloses the rim 16 all the way round. This avoids the rim 16 being able to collide with the flow baffle 19 during a rotation about its longitudinal axis, wherein at the same time the flow baffle 19 is brought as close as possible to the rim 16.

Figure 10:
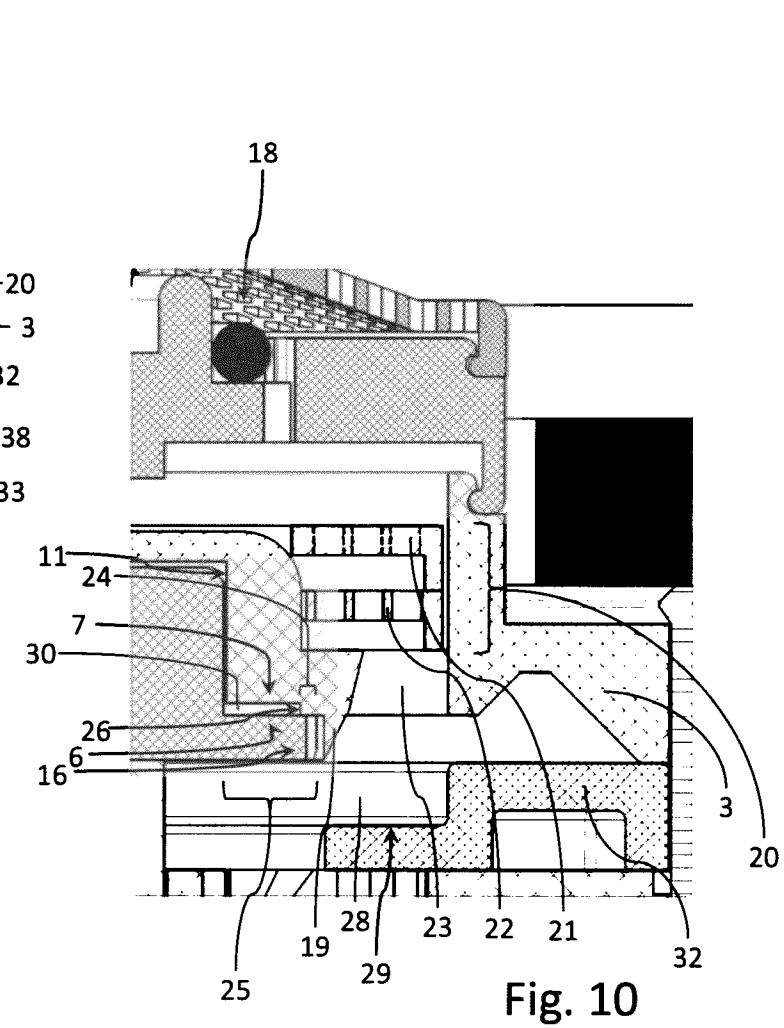
FIG. 10 shows an enlarged detail from FIG. 9.
Figure 12:
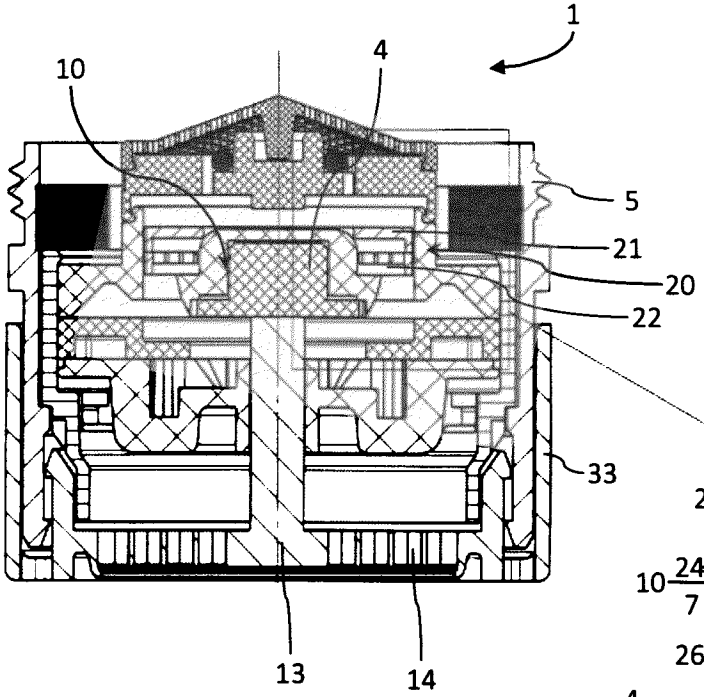
FIG. 12 shows the sanitary outlet unit according to FIG. 9 in order to illustrate the position of the enlarged detail in FIG. 13.

FIGS. 10 and 12 show more exactly that the counterpart surface 7 is divided by a step 26. In this way, a contact region 24 is formed in which the contact surface 6 and the counterpart surface 7 bear flat on each other.

This contact region 24 is only a fraction of the surface area 25 covered by the valve element 4, more precisely by the rim 16 of the latter. In terms of manufacturing technology, this small area can easily be made sufficiently flat such that the contact surface 6 bears sufficiently tightly on the counterpart surface 7, in order to hold the valve element 4 in the upper position by the water pressure.

By the step 26, a gap 30 is thus formed by which the contact surface 6 is at a distance from the counterpart surface 7 on the other side of the contact region 24. Here, therefore, irregularities have no effect on the hold of the valve element 4.

Figure 13:
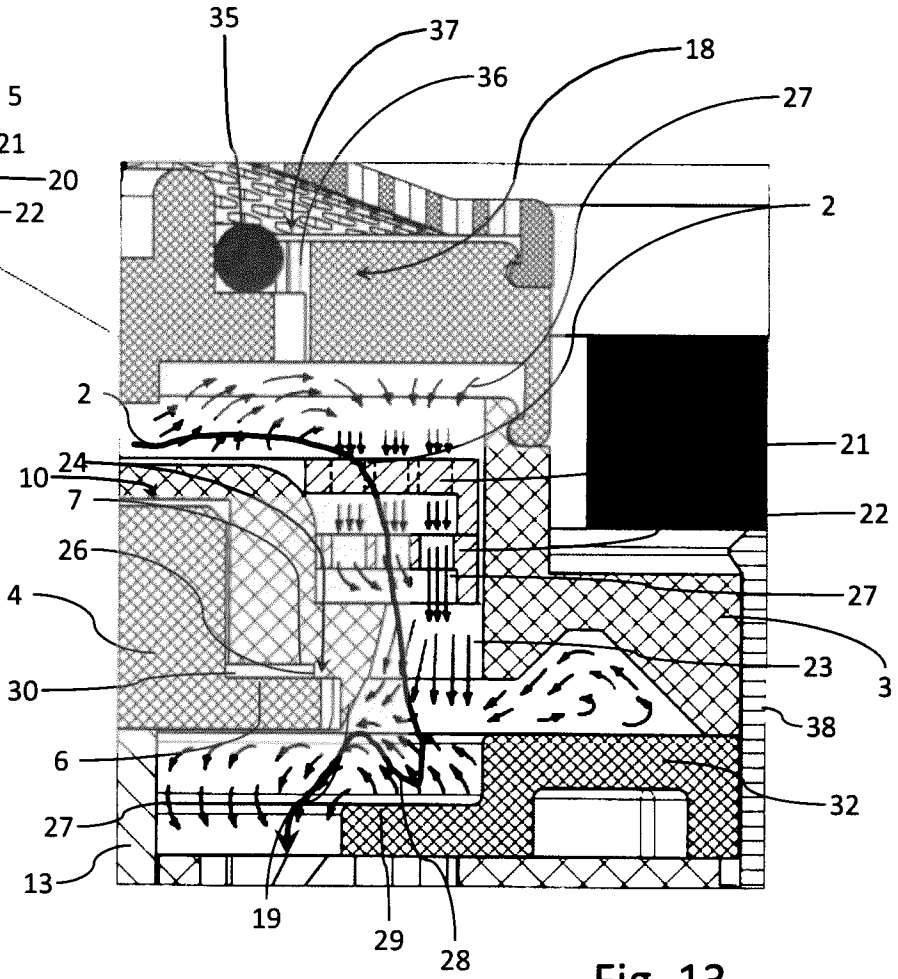
FIG. 13 shows an enlarged detail from FIG. 12 with flow velocity vectors.

In FIG. 13, the course of the flow in the flow path 2 is indicated by flow velocity vectors 27. Here, the plotted line of the flow path 2 is to be interpreted as an approximation of the basic course of the flow.

The straightening effect of the flow straightener 20 can be seen from the fact that the flow velocity vectors 27, after emerging from the through-flow nozzle 23, define a general direction of flow with a low degree of swirling. Although downstream structures cause a renewed increase in swirling, they do so to an acceptable extent.

It will be seen that the flow is reflected in the direction of the valve element 4 from an impact surface 29 at the impact part 32. To prevent the flow from penetrating here between the contact surface 6 and the counterpart surface 7 and thus causing the valve element 4 to detach from the upper position, the already described flow baffle 19 is provided.

FIG. 11 shows the outlet unit 1 in an exploded view. The outlet unit 1 accordingly has a flow rate regulator 18 onto which a dome screen (not shown in FIG. 11) is mounted. The flow rate regulator 18 has, in a manner known per se, a regulating body 35 which, with a regulating profile 36, defines a regulating gap 37 in such a way that a constant flow rate can be achieved in a manner independent of pressure.

Arranged underneath the flow rate regulator 18 in the direction of flow is the housing 3, into which the inserts 34 in the form of perforated plates are fitted, which form the stages 21, 22 of the flow straightener 20.

Downstream on the housing 3, the receiving space 10 is formed which receives the displacement body 9 of the valve element 4.

The housing 3 is followed by the impact part 32, which provides the impact surface 29 (cf. FIG. 10) and the valve seat 15.

This is followed by the splitter part 31 which, in a manner known per se, aerates the water stream.

Figure 9:
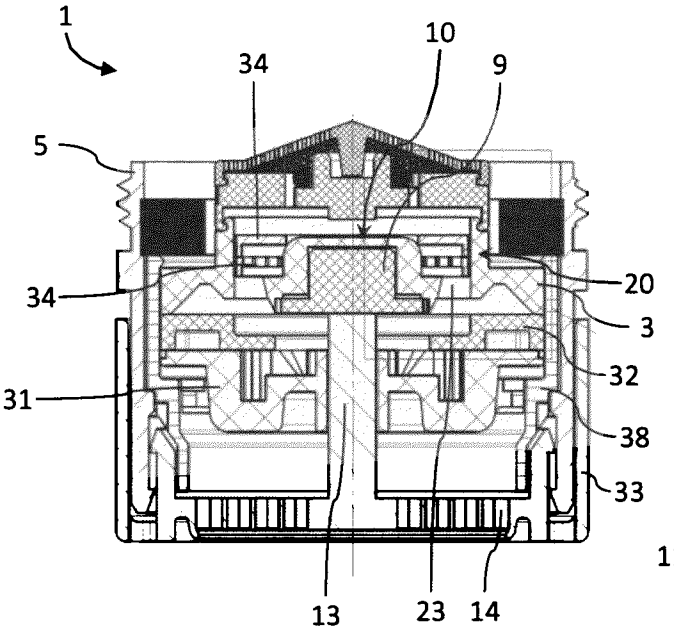
FIG. 9 shows the sanitary outlet unit according to FIG. 6 in a longitudinal section.

It will also be seen from FIG. 9 that the actuating element 13 is connected on the outside to a sleeve-shaped handle 33. The actuating element 13 can thus be activated from outside, without having to intervene in the water jet. In the present illustrative embodiment, this connection is realized via the outlet structure 14. However, it can also be configured separately from the outlet structure 14.

A sleeve part 38 receives the splitter part 31, the impact part 32 and the housing 3 with the clipped-on flow rate regulator 28. The sleeve part 38 is held in the outlet mouthpiece 5, which can be screwed into a faucet outlet (not shown in detail).

In summary, it is thus provided according to the invention that, in a sanitary outlet unit 1, a contact surface 6 is formed on a valve element 4 which is adjustable between an open position and a closed position in a flow path 2, which contact surface 6, in the open position, covers a corresponding, stationary counterpart surface 7 and, in the closed position, frees said counterpart surface 7, such that the valve element 4 is automatically held in the open position by the pressure in the flow path and returns to the closed position in the event of a pressure drop.

LIST OF REFERENCE SIGNS

1 sanitary outlet unit
2 flow path
3 housing
4 valve element
5 mouthpiece
6 contact surface
7 counterpart surface
8 impingement surface
9 displacement body
10 receiving space
11 inner wall
12 relief channel
13 actuating element
14 outlet structure
15 valve seat
16 rim
17 flattened region
18 flow rate limiter
19 flow baffle
20 flow straightener
21 first stage of 20
22 second stage of 20
23 through-flow nozzle
24 contact region
25 surface area
26 step
27 flow velocity vector
28 valve chamber
29 impact surface
30 gap
31 splitter part
32 impact part
33 handle
34 insert
35 regulating body
36 regulating profile
37 regulating gap
38 sleeve part

The invention claimed is:

1. A sanitary outlet unit, comprising:

a housing (3) having an inlet and an outlet;

a valve element (4) arranged in a flow path (2) in the housing (3) between the inlet and the outlet, the valve element is switchable between an open position and a closed position, the closed position being arranged below the open position in a use position of the sanitary outlet unit, and the valve element is configured to automatically fall to the closed position upon a pressure drop of water in the flow path;

the valve element (4) has a contact surface (6) which, in the open position, bears on a counterpart surface (7) of the housing (3) and, in the closed position, is spaced apart from the counterpart surface (7), such that the counterpart surface (7) in the closed position is adapted to be wettable by water in the flow path (2);

an impact surface (8) formed on the valve element (4) and, in the open position, the impact surface is adapted to be acted upon by a pressure prevailing in the flow path (2), such that the contact surface (6) is pressed against the counterpart surface (7); and an actuating element (13) that is accessible from outside the housing (3) and with which the valve element (4) is transferable from the closed position to the open position, and the flow path is limited to a greater extent in the closed position than in the open position to provide a positive flow rate to the outlet that is lower than a flow rate to the outlet in the open position for an automatic water saving function.

2. The sanitary outlet unit (1) as claimed in claim 1, wherein the impact surface (8) is formed on a side of the valve element (4) directed away from the contact surface (6), and a displacement body (9) is formed on the valve element (4), said displacement body (9), in the open position, is arranged in a receiving space (10) closeable by the contact surface (6) and the counterpart surface (7) and, in the closed position, is arranged at least partially outside the receiving space (10).

3. The sanitary outlet unit (1) as claimed in claim 2, wherein the displacement body (9) is guided in the receiving space (10).

4. The sanitary outlet unit (1) as claimed in claim 2, further comprising at least one relief channel (12) that opens into the flow path (2) formed between the displacement body (9) and an inner wall (11) of the receiving space (10), and water displaced from the receiving space (10) is adapted to be removed via said relief channel (12).

5. The sanitary outlet unit (1) as claimed in claim 1, wherein the actuating element (13) is rod-shaped.

6. The sanitary outlet unit (1) as claimed in claim 1, wherein the actuating element (13) is formed separately from the valve element (4) and is movable independently thereof.

7. The sanitary outlet unit (1) as claimed in claim 6, wherein the actuating element (13) is guided displaceably in the housing (3).

8. The sanitary outlet unit (1) as claimed in claim 1, further comprising a flow obstacle formed by or at a valve seat (15) of the valve element (4), and in the open position in the flow path (2), the impact surface (8) is arranged upstream from the flow obstacle.

9. The sanitary outlet unit (1) as claimed in claim 8, wherein the contact surface (6) is formed on an encircling rim (16) which, in the closed position, interacts with the valve seat (15) to provide an at least partial closure.

10. The sanitary outlet unit (1) as claimed in claim 1, further comprising a flow rate regulator or flow rate limiter (18) arranged upstream from the valve element (4) in the flow path (2).

11. The sanitary outlet unit (1) as claimed in claim 1, wherein the contact surface (6), in the closed position, is on the inflow side of the valve element (4).

12. The sanitary outlet unit (1) as claimed in claim 2, wherein the displacement body (9) is made of a metallic material, and the actuating element (13) is made of plastic.

13. The sanitary outlet unit (1) as claimed in claim 1, further comprising a flow baffle (19) arranged such that, in the closed position, the valve element (4) is at least partially screened off in a circumferential direction, and the flow baffle (19) is arranged behind the impact surface (29) and protrudes into a valve chamber (28) that receives the valve element (4).

14. The sanitary outlet unit (1) as claimed in claim 1, further comprising a flow straightener (20) arranged in the flow path (2) before the valve element (4).

15. The sanitary outlet unit (1) as claimed in claim 14, wherein the flow straightener (20) has a multi-stage configuration, and includes at least one insert (34) that forms a step (21, 22).

16. The sanitary outlet unit (1) as claimed in claim 14, further comprising at least one through-flow nozzle (23) arranged in the flow path (2) between the flow straightener (20) and the valve element (4).

17. The sanitary outlet unit (1) as claimed in claim 1, wherein the contact surface (6) bears on the counterpart surface (7) in a contact region (24), and a distance is formed outside of the contact region (24), and a surface area of the contact region (24) is smaller than a surface area of a surface (25) covered by the contact surface.

18. A method for actuating the sanitary outlet unit (1) as claimed in claim 1, the method comprising:

arranging the valve element (4) in the flow path (2) in the housing (3) of the sanitary outlet unit,;

transferring the valve element (4) from the closed position to the open position lying above the closed position;

acting on the valve element (4), in the open position, by the pressure prevailing in the flow path (2), and pressing and holding the contact surface (6) of the valve element (4) against the counterpart surface (7) on the housing (3); and after a pressure drop in the flow path (2), the valve element (4) automatically falling to the closed position to provide the positive flow rate to the outlet that is lower than the flow rate to the outlet prior to the pressure drop providing the automatic water saving function.

19. The method as claimed in claim 18, wherein after the pressure drop in the flow path (2), the valve element (4) falls automatically to the closed position due to inherent weight thereof.

20. The method as claimed in claim 18, wherein the pressure is generated by a flow obstacle arranged downstream from the valve element (4) in the open position.

21. The method as claimed in claim 18, wherein when the valve element (4) is transferred to the open position, the method further comprises displacing water from a receiving space (10) for a displacement body (9) of the valve element (4) via at least one relief channel (12).

22. The method as claimed in claim 18, further comprising holding the valve element (4), in the closed position, against a valve seat (15) by a pressure arising at the contact surface (6) in the flow path (2).

* * * * *